US006334608B1

(12) United States Patent
Stubler

(10) Patent No.: US 6,334,608 B1
(45) Date of Patent: Jan. 1, 2002

(54) DEVICE FOR DAMPING VIBRATION IN A CABLE

(75) Inventor: Jérôme Stubler, Paris (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 09/230,425

(22) PCT Filed: Jul. 23, 1997

(86) PCT No.: PCT/FR97/01374

§ 371 Date: Jan. 26, 1999

§ 102(e) Date: Jan. 26, 1999

(87) PCT Pub. No.: WO98/04780

PCT Pub. Date: Feb. 5, 1998

(30) Foreign Application Priority Data

Jul. 26, 1996 (FR) ..... 96 09449

(51) Int. Cl.[7] ..... F16F 5/00
(52) U.S. Cl. ..... 267/140.13; 267/136
(58) Field of Search ..... 267/140.13, 140.3, 267/136, 148, 141.1; 248/636, 74.1, 74.2, 74.3, 74.4, 562, 49, 65, 500

(56) References Cited

U.S. PATENT DOCUMENTS 4,090,168 A * 5/1978 Miller et al. ..... 367/131
4,274,761 A * 6/1981 Boguth ..... 267/141.1 X
4,995,583 A 2/1991 De La Fuente
5,463,193 A * 10/1995 Carpenter et al. ..... 181/207

FOREIGN PATENT DOCUMENTS

| | | |
|---|---|---|
| DE | 34 34 620 | 4/1986 |
| DE | 295 17 250 | 12/1995 |
| EP | 0 343 054 | 11/1989 |
| FR | WO 98/27362 | * 6/1998 |
| JP | 8 277 874 | * 10/1996 |

OTHER PUBLICATIONS

Tanaka Tatsuo, "Dampening Structure for Cable, and Executing Method Therefor", Patent Abstracts of Japan—Edited by the European Patent Office, RE Japanese Patent Application Publiucation No. 06073711, Mar. 15, 1994.

* cited by examiner

*Primary Examiner*—Douglas C. Butler
*Assistant Examiner*—Melanie Torres
(74) *Attorney, Agent, or Firm*—Cantor Colburn LLP

(57) ABSTRACT

The device includes a first member surrounding and secured to a section of a cable, a second member connected to an element to which a portion of the cable is attached, and arranged around said first member, a resilient or viscoelastic ring engaging the first member and the second member, and a flexible container housed in a ring-shaped compartment between the two members and filled with a viscous substance.

25 Claims, 3 Drawing Sheets

DEVICE FOR DAMPING VIBRATION IN A CABLE

BACKGROUND OF THE INVENTION

The present invention concerns a device for damping vibration in a cable. It has particular but not exclusive application in the field of civil engineering works with a structure using such cables, for example suspension or cable-stayed bridges.

These cables or stays are subjected to vibration caused by the wind and/or the rain or else by vehicle traffic on the bridge.

The invention concerns more exactly a device including a first member surrounding and secured to a section of the cable, a second member, connected to an element to which a cable portion is attached, and arranged around the first member, and damping means arranged between the first and second members.

A device of this type, for damping vibration in a stay, is described in European patent 0 343 054. In the damping device presented in this document, the two members delimit a ring-shaped cavity filled with a viscous substance providing the required damping during relative motions of the two members.

This former device has good performance in terms of damping. It has the further advantage of being relatively compact and of not being detrimental to the aesthetic quality of the structure. However, ensuring a seal between the ring-shaped cavity and the exterior can be tricky. A set of joints has to be set in place, which limits the reliability of the device and complicates its installation. On the other hand, the development of a particular device requires a special design of the two members and appropriate sealing means, with this design having to be re-conceived each time, for example, that changes are made to the stay dimensions or to the required dynamic properties.

One object of the present invention is to propose a damping device for a tensioned cable, as a straightforward and reliable response to problems of sealing, the achievement of which is facilitated.

SUMMARY OF THE INVENTION

The invention thus proposes a damping device of the type mentioned in the introduction, in which damping means include on the one hand a resilient or visco-elastic ring engaging the first member and the second member, on the other hand a flexible container containing a viscous substance, this flexible container being housed in a ring-shaped compartment formed between the first and second members.

The flexible container constitutes a constant volume damping chamber which can be easily sealed. Cable vibration is effectively attenuated through the combined effect of the resilient or visco-elastic ring and the viscous damping provided by the substance contained in the flexible container. Dissipation of vibrational energy results from the movements of the viscous substance in the flexible container, prompted when the cable vibrates relative to the element to which it is attached.

In a preferred version, the flexible container consists of a hose coiled in the ring-shaped compartment. It is thus possible to adapt to different dimensions of the cable or stay to be damped, simply by adjusting the length of the hose.

To facilitate the installation of the device, the resilient or visco-elastic ring may be composed of two parts of generally semi-cylindrical shape which can be attached to each other by means of pins approximately parallel to the cable section, of assembly bolts or else of a tightening belt.

To advantage, each of these parts comprises several metal half-bushings sunk into a resilient or moulded visco-elastic material, the half-bushing ends protruding from the moulded material and being provided respectively with assembly means such as pinning apertures.

In a version of this latter type, each of the parts comprises two outer half-bushings of the same diameter, located on either side, an inner half-bushing of smaller diameter relative to the cable section direction. It is then the flexibility of the resilient or visco-elastic material between the inner half-bushing and the outer half-bushings which enables the relative motion of the cable section relative to the second member, while exerting return force towards the normal position.

DESCRIPTION OF THE PREFERRED EMBODIMENTS

Figure 1:
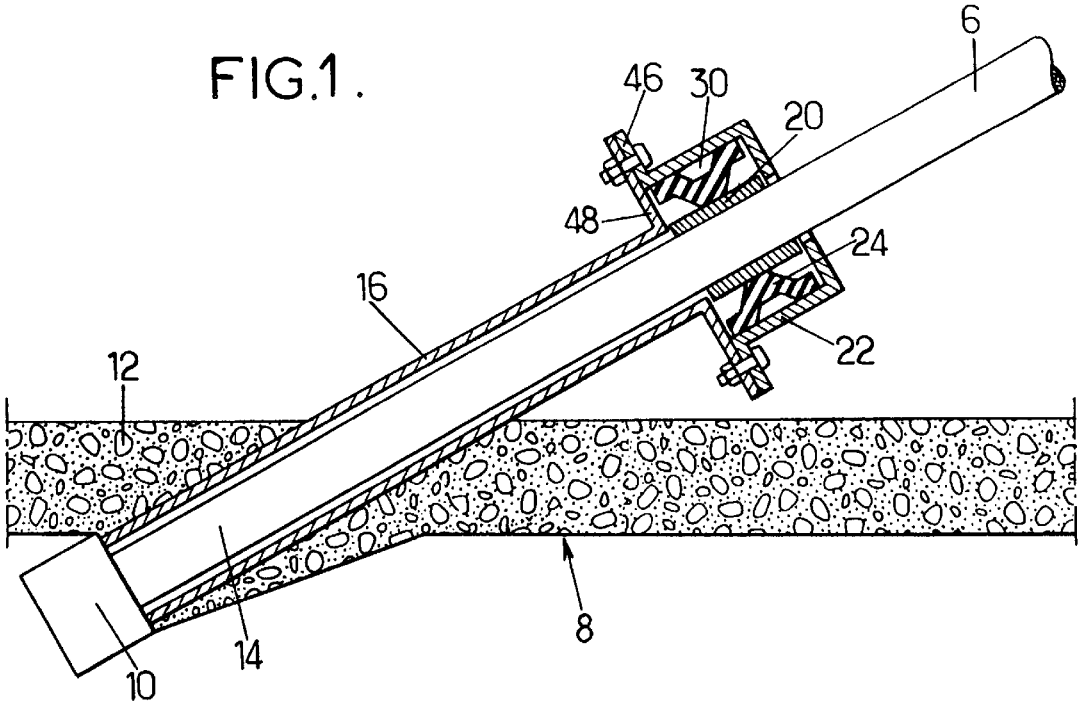
FIG. 1 shows diagrammatically how a device in accordance with the invention is placed near the anchored end of a stay.

FIG. 1 shows diagrammatically the place where a damping device may be placed in accordance with the invention on the stay 6 of a structure 8 such as a cable-stayed bridge.

In a known way, the stay is anchored at its two ends on respective blocks 10 integral with appropriate footings and structure elements 12. In the example shown in FIG. 1, the damping device is placed near the lower end 14 of the stay 6, anchored in the apron 12 of the bridge. It will be understood that a similar structure may be placed near the upper end of the stay 6, anchored in a bridge tower.

The end 14 of the stay passes into a rigid tubular guide 16 fixed to the anchoring block 10.

Figure 2:
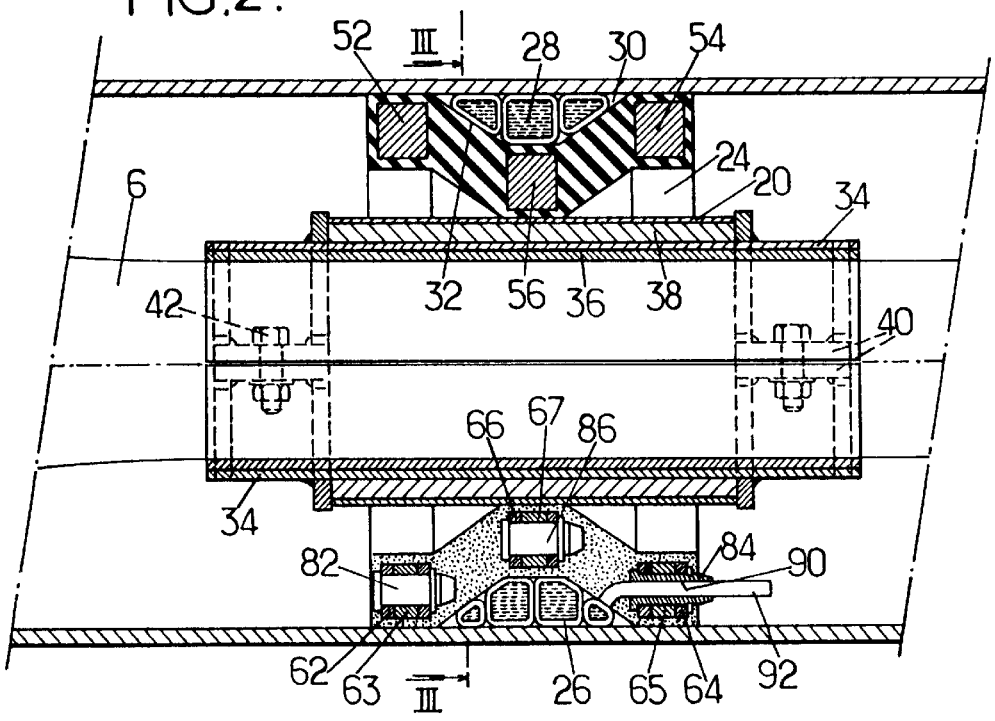
FIG. 2 is an axial sectional view of a device in accordance with the invention.

The damping device, which is shown very diagrammatically in FIG. 1 and in more detail in FIG. 2, comprises:

- an inner tube 20 into which passes a stay section 6, and fixed to this section;
- an outer tube 22 placed around the inner tube 20;
- a resilient or visco-elastic ring 24 one inner face of which is supported against the inner tube 20 and an outer face is supported against the outer tube 22;
- a flexible container such as a hose 26 containing a viscous substance 28.

In the example in FIG. 2, this container 26 is housed in a ring-shaped compartment 30 delimited on the one hand by a ring-shaped groove 32 with a V-shaped cross section present on one face of the resilient ring 24, and on the other hand by one of the tubes 20, 22 (the outer tube 22 in the example shown).

Figure 3:
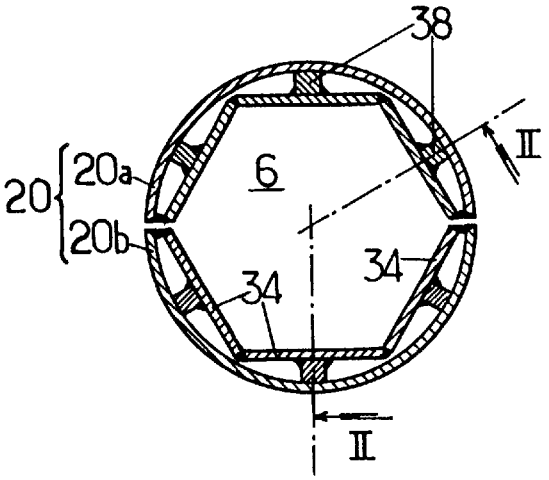
FIG. 3 is a cross sectional view, along the plane III—III shown in FIG. 2, of an inner the of the device, and showing additionally the sectional plane II—II of FIG. 2.

FIGS. 2 and 3 show a possible assembly of the inner tube 20 on the stay 6 in the case where the latter is composed of strands collected into a bundle of hexagonal cross section. The tube 20 consists of two semi-cylindrical portions 20*a*, 20*b* each belonging to a respective bush. Each of the bushes includes three plates 34 which are applied against the sides of the hexagonal section of the stay, with interposition of a strip of adhesive 36. Longitudinal wedges 38 are welded between the semi-cylindrical portion 20*a* and the plates 34, at the centre of the latter. As is shown in FIG. 1, the plates 34 have two axial ends which protrude from the tube 20. At these ends, the two bushes comprise lateral edges 40 enabling their assembly by means of screws 42. The tightening of the screws 42 enables the tube 20 to be locked on the stay 6 section.

The outer tube 22 is presented as a cylindrical casing which, in use, is attached to the tubular guide 16 anchored to the footing. In the assembly example shown in FIG. 1, the outer tube 22 has towards the lower end of the stay a flange 46 bolted on an additional flange 48 provided at the outlet of the tubular guide 16.

In order to facilitate its installation on the stay, the resilient ring 24 is constituted in two halves of generally semi-cylindrical shape assembled after their installation on the inner tube 20.

Figure 4:
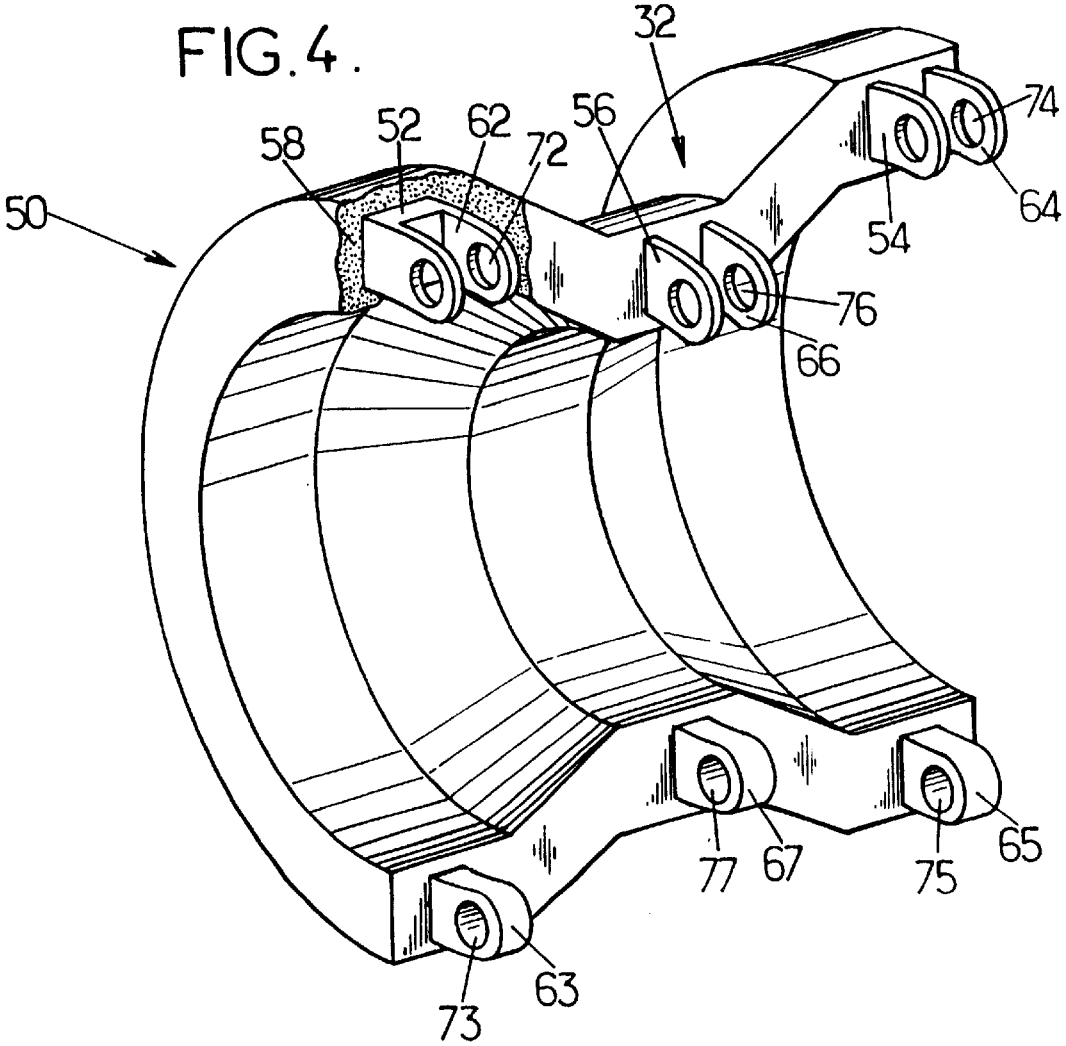
FIG. 4 is a perspective view of a moulded part forming half of a resilient ring of the device shown in FIG. 2.

Such a half-ring 50 is shown in FIG. 4. It is composed of three metal half-bushings 52, 54, 56 sunk by moulding into an elastomer material 58, namely two outer half-bushings of the same diameter 52, 54 and an inner half-bushing of smaller diameter 56. In a radial plane, the elastomer material 58 has a generally V-shaped cross section, the inner half-bushing 56 being located at the base of this V, and the two outer half-bushings 52, 54 being located at the ends of the branches of this V. The groove 32 is thus determined between the two branches of the V constituted of elastomer material capable of compression under the stress of transverse vibration of the stay 6.

As is shown by the upper part of FIG. 2 and the partial stripping of the elastomer material 58 in FIG. 4, the metal half-bushings 52, 54, 56 each have, over most of their perimeter, a rectangular shaped cross section. To allow the assembly of the two halves 50, the half-bushings 53, 54, 56 each have their two ends 62, 64, 66 which protrude from the moulded elastomer material 58. One end 62, 64, 66 of each half-bushing 52, 54, 56 is in the shape of a clevis provided with a pinning aperture 72, 74, 76, whereas the other end 63, 65, 67 has a complementary shape of the clevis and is provided with a corresponding pinning aperture 73, 75, 77. The pinning apertures 72–77 allow the assembly of the two ring halves 50 by means of three pairs of pins 82, 84, 86 extending parallel to the direction of the stay section 6 (see the lower part of FIG. 2).

A ring half 50 is easily manufactured by injecting the elastomer material 58 into an appropriately shaped mould in which have previously been placed the three half-bushings 52, 54, 56, then by vulcanising the elastomer material. The stiffness of the resilient ring 24 may be adjusted in accordance with the required dynamic properties by working on the elasticity parameters and levels of thickness of the resilient or moulded visco-elastic material.

In the device in FIG. 2, the flexible hose 26 is coiled in a helix in the compartment 30 delimited on the one hand by the groove 32 of the ring 24, and on the other hand by the inner face of the outer tube 22. The hose 26 has one of its ends closed, and its other end which communicates with the outside of the compartment 30 by means of a bore 90 arranged in a drift pin 84 of one of the pairs of outer half-bushings 54 of the resilient ring 24. This end 92 of the hose 26 is thus accessible to fill the latter with the viscous damping substance. This substance 28 is typically an oil or another viscous fluid, or a viscous gel the viscosity of which is optimised as a function of the characteristics of the stay to be damped.

The installation of the damping device described above is carried out for example in the following way. The strands of the stay 6 are installed and anchored at their two ends, by passing them through the tubular guide 16 and the outer tube 22. The tube 22 is then separated from the guide 16 so as to give access to the stay section receiving the device. The inner tube 20 is installed and locked on the stay section by assembling its two bushes and by tightening the screws 42. The two halves of the ring 24 are then installed around the inner tube 20, then pinned. After coiling the flexible hose 26 in the groove 32, the outer tube 22 is engaged around the whole, the hose 26 is filed with oil 28, and the outer tube 22 is attached to the flange 48 of the tubular guide 16. When the strand 6 comprises an outer protective casing, the latter may be attached on the end of the outer tube 22 opposite the guide 16.

Figure 5:
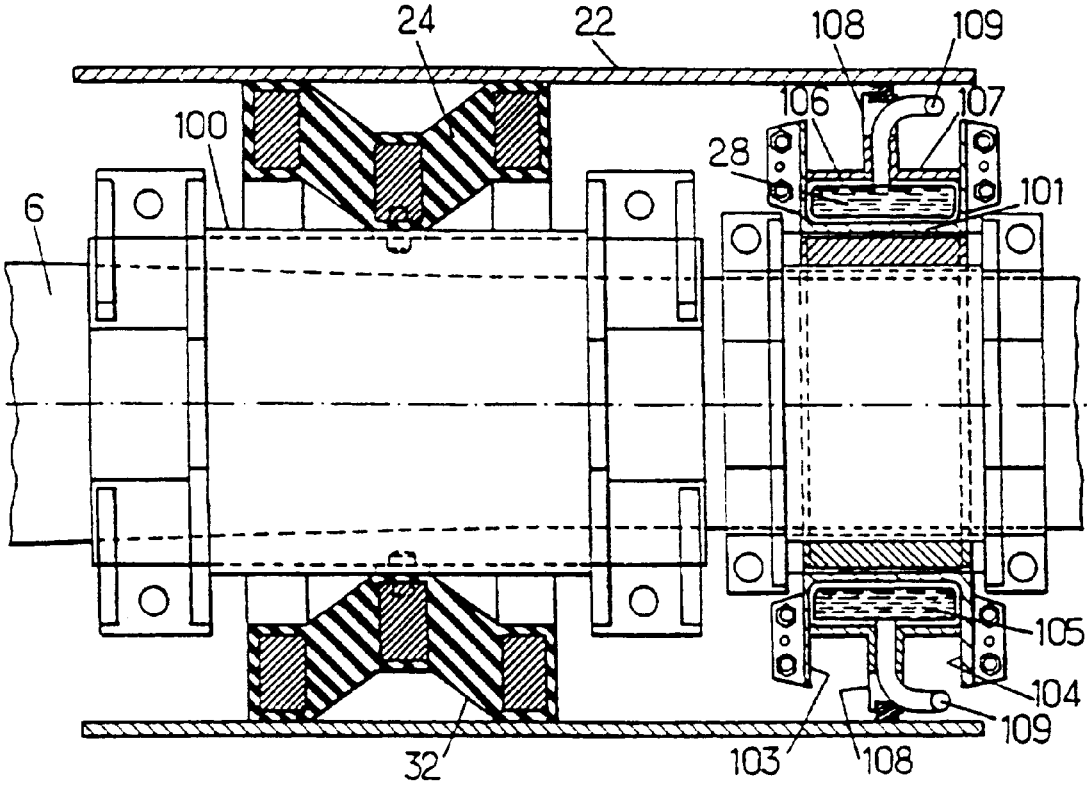
FIG. 5 is an axial sectional view of another version example of a device in accordance with the invention.

FIG. 5 shows a version variant of the invention, in which the ring 24 and the ring-shaped compartment where the flexible container is housed are juxtaposed along the direction of the stay 6 section. The inner tube is divided into two juxtaposed sections 100, 101 attached to the stay in the manner described by reference to FIG. 3. One of these sections 100 receives the ring 24 which has the same structure and the same mode of assembly as previously (FIG. 4), except that the groove 32 is not used for containing the viscous substance container.

The other section 101 of the inner tube is provided with two transverse flanges 103, 104 at its axial ends. The ring-shaped compartment 105, receiving the flexible container 106 of viscous material 28, is delimited internally by the inner tube section 101, and axially by the two flanges 103, 104. Outwards, this compartment 105 is delimited by a bushing 107 acting as a piston. This bushing 107 is presented in the form of two half-bushings assembled around the stay during the installation of the device. Outwards, the half-bushings have radial protrusions 108 by which they rest on the outer tube 22.

In the version in FIG. 5, the flexible container 106 consists of a pocket occupying the axial length of the ring-shaped compartment 105 and encasing the perimeter of the tube section 101. This pocket 106 is filled with viscous substance 28 after installation of the unit via conduits 109 passing through the bushing 107 and its protrusions 108 as shown in FIG. 5. In use, vibration in the stay results in the piston-bushing 107 being moved radially relative to the tube section 101 and to the flanges 103, 104 so that the substance contained in the pocket 106 moves within a constant volume chamber and provides the damping required.

Although the invention has been described by reference to particular version examples, it will be understood that various variants may be provided to these examples without departing from the context of the present invention. Thus, a device in accordance with the invention may be used to damp vibration in a cable other than a stay, for example a track cable or a suspension bridge hanger or again a submarine cable etc. The cable portion attached to a footing or the like is not necessarily one of its ends. On the other hand the element to which this portion is attached may be a footing or any structure element, including a cable network.

What is claimed is:

1. A device for damping vibration in a tensioned cable, comprising:

a first member surrounding and secured to a section of the cable;

a second member arranged around the first member with a space therebetween, and connected to an element to which a portion of the cable is attached; and damping means arranged in the space between the first and second members, wherein the damping means comprise a resilient or visco-elastic ring engaging the first member and the second member, and a flexible container containing a viscous substance, said flexible container being housed in a ring-shaped compartment formed in the space between the first and second members, and said flexible container comprising a hose coiled in the ring-shaped compartment.

2. A device according to claim 1, wherein the resilient or visco-elastic ring is composed of two parts of generally semi-cylindrical shape.

3. A device according to claim 2, wherein the two parts of generally semi-cylindrical shape are attached to each other by means of pins approximately parallel to the cable section.

4. A device according to claim 3, wherein the resilient or visco-elastic ring has a groove which, with one of the members delimits the ring-shaped compartment, and wherein one of the pins comprises an axial bore giving access to flexible container for filing the container.

5. A device according to claim 2, wherein each of the two parts of generally semi-cylindrical shape comprises several metal half-bushings sunk into a moulded resilient or visco-elastic material, the ends of the half-bushings protruding from the moulded material and being respectively provided with assembly means.

6. A device according to claim 5, wherein each of the parts of generally semi-cylindrical shape comprises two outer half-bushings having a first diameter, located on either side of an inner half-bushing having a second diameter smaller than said first diameter relative to the direction of the cable section, whereby flexibility of the resilient or visco-elastic material between the inner half-bushing and the outer half-bushings permits a relative motion of the cable section relative to the second member.

7. A device according to claim 1, wherein the resilient of visco-elastic ring has a groove which, with one of the members delimits the ring-shaped compartment.

8. A device according to claim 1, wherein the resilient or visco-elastic ring and the ring-shaped compartment where the flexible container is housed are juxtaposed along the direction of the cable section.

9. A device according to claim 8, wherein the ring-shaped compartment is delimited internally by the first member, axially by two transverse flanges integral with the first member, and externally by a bushing resting on the second member and movable radially between the flanges relative to the first member.

10. A device for damping vibration in a tensioned cable, comprising:

a first member surrounding and secured to a section of the cable, a second member arranged around the first member with a space therebetween, and connected to an element to which a portion of the cable is attached; and damping means arranged in the space between the first and second members, wherein the damping means comprise a resilient or visco-elastic ring engaging the first member and the second member, and a flexible container a viscous substance, said flexible container being housed in a ring-shaped compartment formed in the space between the first and second members, the resilient or visco-elastic ring is composed of two parts of generally semi-cylindrical shape, the two parts of generally semi-cylindrical shape are attached to each other by means of pins substantially parallel to the cable section.

11. A device according to claim 10, wherein the resilient or visco-elastic ring has a groove which, with one of the said members, delimits the said ring-shaped compartment.

12. A device according to claim 10, wherein the resilient or visco-elastic ring has a groove which, with one of said members delimits said ring-shaped compartment, and wherein one of the pins comprises an axial bore giving access to the flexible container for filling said container.

13. A device according to claim 10, wherein the resilient or visco-elastic ring and the ring-shaped compartment where the flexible container is housed are juxtaposed along the direction of the cable section.

14. A device according to claim 13, wherein the ring-shaped compartment is delimited internally by the first member, axially by two transverse flanges integral with the first member, and externally by a bushing resting on the second member and movable radially between flanges relative to the first member.

15. A device according to claim 10, wherein each of the parts of generally semi-cylindrical shaped comprises several metal half-bushings sunk into a moulded resilient or visco-elastic material, the ends of the half-bushings protruding from the moulded material and being respectively provided with assembly means.

16. A device according to claim 15, wherein each of the parts of generally semi-cylindrical shape comprises two outer half-bushings having a first diameter, located on either side of an inner half-bushing having a second diameter smaller than said first diameter relative to the direction of the cable section, whereby flexibility of the resilient or visco-elastic material between the inner half-bushing and the outer half-bushings permits a relative motion of the cable section relative to the second member.

17. A device for damping vibration in a tensioned cable, comprising:

a first member surrounding and secured to a section of the cable, a second member arranged around the first member with a space therebetween, and connected to an element to which a portion of the cable is attached; and damping means arranged in the space between the first and second members, wherein the damping means comprise a resilient or visco-elastic ring engaging the first member and the second member, and a flexible container containing a viscous substance, said flexible container being housed in a ring-shaped compartment formed in the space between the first and second members, the resilient or visco-elastic ring is composed of two parts of generally semi-cylindrical shape, and each of the parts of generally semi-cylindrical shape comprises several metal half-bushings sunk into a moulded resilient or visco-elastic material, the ends of the half-bushings protruding from the moulded material and being respectively provided with assembly means.

18. A device according to claim 17, wherein each of the parts of generally semi-cylindrical shape comprises two outer half-bushings having a first diameter, located on either side of an inner half-bushing having a second diameter smaller than said first diameter relative to the direction of the cable section, whereby flexibility of the resilient or visco-elastic material between the inner half-bushing and the outer half-bushings permits a relative motion of the cable section relative to the second member.

19. A device according to claim 17, wherein the resilient or visco-elastic ring has a groove which, with one of the said members, delimits the said ring-shaped compartment.

20. A device according to claim 17, wherein the resilient or visco-elastic ring and the ring-shaped compartment where the flexible container is housed are juxtaposed along the direction of the cable section.

21. A device according to claim 20, wherein the ring-shaped compartment is delimited internally by the first member, axially by two transverse flanges integral with the first member, and externally by a bushing resting on the second member and movable radially between the flanges relative to the first member.

22. A device for damping vibration in a tensioned cable, comprising:

a first member surrounding and secured to a section of the cable, a second member arranged around the first member with a space therebetween, and connected to an element to which a portion of the cable is attached; and damping means arranged in the space between the first and second members, wherein the damping means comprise a resilient or visco-elastic ring engaging the first member and the second member, and a flexible container containing a viscous substance, said flexible container being housed in a ring-shaped compartment formed in the space between the first and second members, and the resilient or visco-elastic ring has a groove which, with one of the said members, delimits the said ring-shaped compartment.

23. A device according to claim 22, wherein the resilient or visco-elastic ring and the ring-shaped compartment where the flexible container is housed are juxtaposed along the direction of the cable section.

24. A device according to claim 23, wherein the ring-shaped compartment is delimited internally by the first member, axially by two transverse flanges integral with the first member, and externally by a bushing resting on the second member and movable radially between the flanges relative to the first member.

25. A device for damping vibration in a tensioned cable, comprising:

a first member surrounding and secured to a section of the cable, a second member arranged around the first member with a space therebetween, and connected to an element to which a portion of the cable is attached; and damping means arranged in the space between the first and second members, wherein the damping means comprise a resilient or visco-elastic ring engaging the first member and the second member, and a flexible container containing a viscous substance, said flexible container being housed in a ring-shaped compartment formed in the space between the first and second members, the resilient or visco-elastic ring and the ring-shaped compartment where the flexible container is housed are juxtaposed along the direction of the cable section, and the ring-shaped compartment is delimited internally by the first member, axially by two transverse flanges integral with the first member, and externally by a bushing resting on the second member and movable radially between the flanges relative to the first member.

* * * * *